United States Patent [19]

Goudy

[11] 3,958,515

[45] Mar. 25, 1976

[54] GRAIN DOOR

[76] Inventor: Donald James F. Goudy, Box 2199, Drumheller, Alberta, Canada, T0J-0Y0

[22] Filed: Oct. 30, 1974

[21] Appl. No.: 519,205

[30] Foreign Application Priority Data

Dec. 19, 1973 Canada ..... 188550

[52] U.S. Cl. ..... 105/467; 160/328; 105/489

[51] Int. Cl.[2] ..... A47H 15/00

[58] Field of Search ..... 105/466, 467, 474, 489, 105/369 R; 160/328

[56] References Cited

UNITED STATES PATENTS

| | | | |
|---|---|---|---|
| 2,669,402 | 2/1954 | Del Mar | 105/467 X |
| 2,827,958 | 3/1958 | Lee | 105/467 X |
| 3,146,729 | 9/1964 | Langston | 105/489 |
| 3,183,855 | 5/1965 | Adler | 105/489 |
| 3,498,358 | 3/1970 | Bruning | 105/489 X |

*Primary Examiner*—John J. Love
*Assistant Examiner*—Michael Mar
*Attorney, Agent, or Firm*—Cushman, Darby & Cushman

[57] ABSTRACT

A fracturable barrier door for grain cars comprising a grid work removably positioned over the door which includes a horizontal member extending between jambs of the door and at least a pair of vertical members extending between the top and bottom of the door opening and being interconnected with the horizontal member. A disposable diaphram is positioned over the grid work on the inside thereof to seal off the interior of the car; and cooperating tubular means on the diaphram and on the door jambs for securing the diaphram thereto.

9 Claims, 7 Drawing Figures

GRAIN DOOR

This invention relates to an improved method of barricading the inner door of a railway boxcar for the purpose of containing granular materials therein such as grain, coal or fertalizer.

Railway boxcars are provided with a sliding storm door only which is not suitable for the containment of granular materials. It has been a common practice therefore to construct an inner door using either wooden boards applied horizontally to the door jambs, or a combination of paperboard and steel straping in order to contain these granular materials. The barricade must be sufficiently strong to withstand the pressure of the granular material contained in the boxcar without bulging to the outer storm door.

Briefly, the type of inner door or barricade used on grain cars must a. be economical enough to be considered disposable inasmuch as the inner door is seldom completely salvaged after dumping;

b. because of the fact that the inner door is usually installed at the loading point by one man, it must be light and easy to install;

c. when installed, it must be so constructed as to allow the boxcar to be loaded by means of a grain spout.

Moreover, the inner door must be sufficiently strong to prevent it from bulging to the point of interfering with the operation of the outer storm door. It must contain very fine granular materials without leaking and thereby causing a loss to the railroad, and it must be so designed as to facilitate all types of dumping equipment now in existence.

The North American railroads are encountering an increasing amount of difficulty with both the wooden and the paperboard steel door now in use. The difficulties with wooden doors are due to many factors such as the accelerating cost of both lumber and labour; increased handling and distribution costs related to the redistribution of the door to the loading points; the strong objection of the part of the elevator operators to handling the heavy wooden panels; and the pollution problem at both the loading and unloading points related to broken doors and wood scraps.

With regards to paperboard-steel doors, there are problems with the increasing cost of both the door and the wooden boards used in conjunction with the paperboard-steel door; and the damage caused by the nailing of the steel straps to the door posts (approximately 70 nails per door required). The railways have found that within less than two years a boxcar must undergo major repairs to the door posts and adjacent walls when the paperboard steel door is used. Additionally, there is the difficulty in disposing of the broken doors and the pollution caused by the steel straping and paperboard both at the loading and unloading areas.

In Canada at least, the railways have assigned many of their boxcars to be used for grain handling only. These cars are returned immediately for reloading and are not used for any other purpose. These boxcars are commonly referred to as the "assigned fleet". The fact that this "assigned fleet" is used only for grain handling opens new possibilities regarding the type and design of the inner door.

It will be appreciated that it is far more economical and practical to install as much as possible of the grain door mechanism as a reusable unit. The disposable portion of the door can then be significantly reduced in price. The present invention satisfies all the requirements of an inner door for railway boxcars. This invention has been treated under actual conditions and has proven to perform without malfunction.

According to a broad aspect a fracturable barricade door for grain cars comprising a grid work rearwardly positioned over said door which includes a horizontal member extending between jambs of the door and at least a pair of vertical members extending between the top and bottom of the door opening and being interconnected with the horizontal member; disposable diaphram positioned over said grid work on the inside thereof to seal off the interior of the car; and means on the door jambs for securing the diaphram thereto.

The invention is illustrated by way of example, in the accompanying drawings in which.

Figure 1:
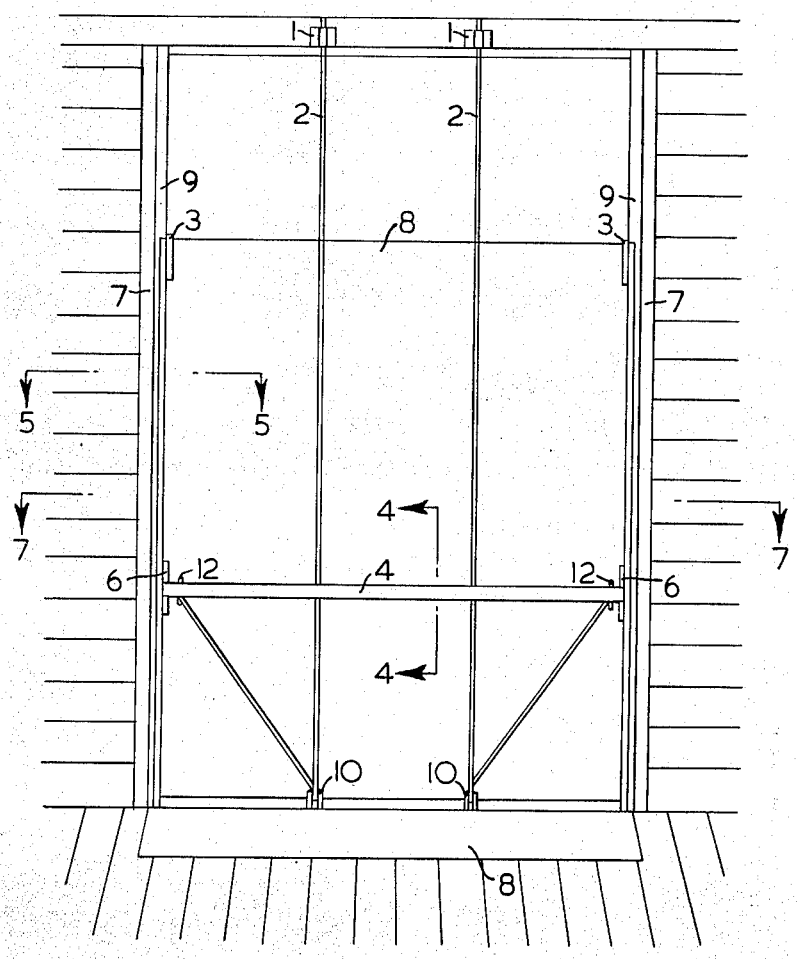
FIG. 1 is an elevation view of the inside of a grain door according to the invention.

Mounting a disposable grain door on a boxcar is known as "coopering" of the car. As shown in FIG. 1, my "coopering" device consists of a disposable membrane 8 supported by a cable and channel-iron retaining mechanism that is permanently mounted into the door frame of the railway boxcar. The disposable membrane 8 is attached to the door frame 9 by means of a continuous tubular mount 7. This mount 7 is made from steel and resembles a water pipe with the seam left open about ⅛ inch.

Figure 5:
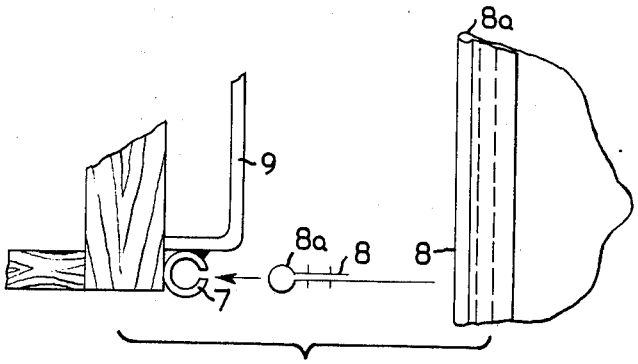
FIG. 5 is a cross section taken along the line 5—5 of of FIG. 1.

The disposable memberane 8, as illustrated in FIG. 5, is fitted with a sewn in rope hem 8*a* on each side. The rope bound hem 8*a* is slid into the mount 7 from the top end until approximately 12 inches of the membrane 8 has projected past the lower end of the mount 7 and lies on the boxcar floor as seen in FIG. 1. The disposable membrane 8 is now fully in position. The section lying on the floor does not require any securement, as it is held in position by the weight of the granular contents of the boxcar.

Although it is possible to use an extruded metal such as aluminum for the mount 7, it is recommended that steel be used which can be welded to the door post 9 and which will be less subject to damage than aluminum.

To prevent the disposable membrane 8 from bulging excessively under load and thereby interfering with the operation of the outside door, a retaining mechanism must be installed in the boxcar door-way. This mechanism must be constructed to be compatible with all of the unloading machinery especially the "door breakers". Additionally, it must be sufficiently low priced to be within the economical limits of the application, and it must be light weight enough to be easily handled by one man. Finally, it must be as maintenance free as possible and be able to withstand rough handling over long periods of time.

Figure 2:
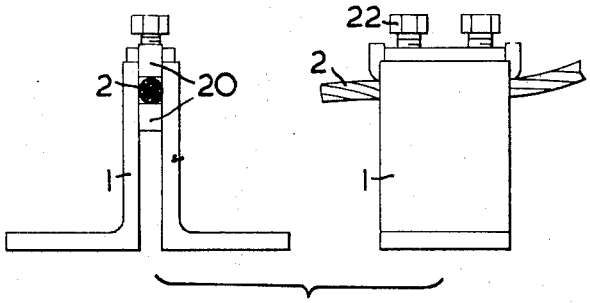
FIG. 2 is an elevation view of the door retaining mounts.
Figure 4:
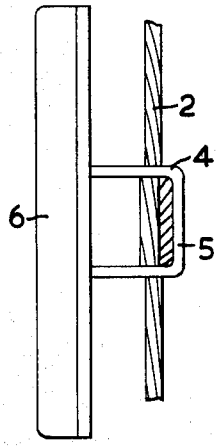
FIG. 4 is a cross section taken along the line 4—4 of FIG. 1.

In the present invention the retaining device consists of a pair of cables 2 attached to mounts 1 which in turn are welded to the top sill above the boxcar door opening. As shown in FIG. 2, the cable 2 is clamped between bars 20 by set screws or bolts 22. A steel channel 4 (FIG. 4) is affixed to the cables 2 by means of metal wedges 5 driven in between the cable 2 and the back flange of the channel iron 4 (illustrated in FIG. 4).

Figure 7:
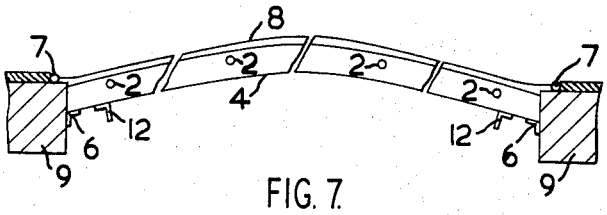
FIG. 7 is a cross section of the door taken along the line 7—7 of FIG. 1.

The channel iron 4 is cambered toward the inside of the boxcar as shown in FIG. 7 to further prevent excessive bulging. The channel iron 4 is prevented from passing through the door-way by a critically located angle iron stop 6, welded to the door frame.

A short piece of angle iron 12 is welded to the back side of the channel 4 to prevent the machanism from falling off the "door breaker" during the dumping operation.

Figure 6:
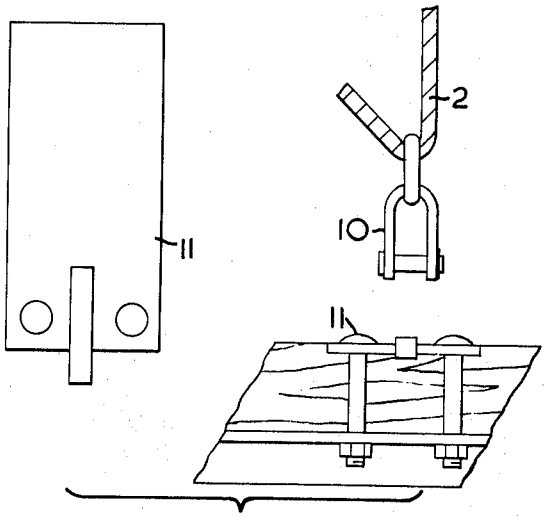
FIG. 6 illustrates the mechanism for securing the grain door to the floor of the car.

A chain link and clevis 10 shown in FIG. 6 is attached to the cable 2 at the floor level. The clevis 10 fits over a pin that is welded to a floor plate 11 which faces into the boxcar. The clevis 10 will remain attached to the floor plate 11 as long as pressure is exerted from within. However, the clevis 10 will release as soon as the "door breaker" exerts enough force to relieve this pressure. The retaining mechanism is then free to be carried into the boxcar by the "door breaker" without causing damage.

The bottom end of the cable 2 is secured to the channel iron 4 using the wedge method previously described.

Figure 3:
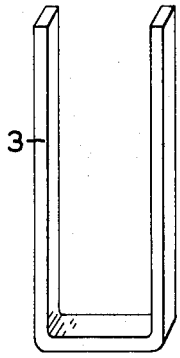
FIG. 3 is an isometric view of a spout board mount.

At approximately seven feet above the floor a "spout board" mount 3 (illustrated in FIG. 3) is welded to the face of the boxcar door frame. This mount 3 is designed to accommodate a 2 inch × 6 inch × 6 foot long board required in the loading operation. This board can be removed immediately after loading and reused many times over. The spout board mount 3 also provides a convenient place to hang the cross channel 4 when not in use.

It is fully possible, although not illustrated that a hanger mount could be installed near the roof of the boxcar which would hold the retaining mechanism completely out of the door-way when not in use. This would render the boxcar servicable for other non-granular merchandise.

The disposable portion 8 of this device consists of a woven seamless fabric tailored as previously mentioned to be compatible with the side mounts 7.

This disposable portion 8 must be sufficiently strong to withstand the extreme pressures under which it must perform without bulging excessively or rupture and because it is demolished at each dumping it must be sufficiently low in cost to render it an expendable item. Moreover, it must be sufficiently weather-proof to withstand heat, extreme cold or moisture without causing damage to the boxcar contents or failure of the door itself.

A fabric that oriented"the above requirements is a fabric woven from "oreiented" polypropolene or polyethelene tapes having a denier weight of between 200 and 2,000 and a tape density of between 5 and 30 tapes per inch. The fabric can either be laminated to a film on one or both sides or remain unlaminated. The term "oriented" tapes referes to the pre-stretching of the tapes after extrusion to increase strength.

It is recommended that a "oriented" and woven polypropolene be used with a denier weight of about 1,000 and a tape count of about 12 × 12 per inch.

The embodiments of the invention in which an exclusive property or privilege is claimed are defined as follows:

1. A fracturable barrier door for grain cars comprising a grid work removably positioned over the inner face of said door and which includes a horizontal member extending between jambs of the door and at least a pair of vertical cable means secured to and extending between the top and bottom of the door opening and being interconnected with the horizontal member; a disposable diaphram positioned over said grid work on the inside thereof to seal off the interior of the car; and means on the diaphram and on the door jambs for removably securing the diaphram thereto; comprising a vertically extending tubular mount secured to the jamb on each side of the door, an open slot in each mount with said slots facing one another; and a flexible, tubular rope means integral with the terminal side edges of the diaphram whereby the rope means may be guided into the tubular mounts with the diaphram extending outwardly through the slots.

2. An inner barricade for a railway boxcar door comprising:

a. a containing mechanism comprised of two steel cables or chains suspended from the top of the door-way at approximately two feet in from each edge; a cambered steel channel attached to the cables at approximately two and a half feet from the floor level, said channel being prevented from passing through the door-way by means of a projection welded to the door face; the cables being attached to the floor by means of a clevis over a horizontally mounted pin facing into the boxcar, the end of the cables being secured to the horizontal channel near each end; wherein the containing mechanism provides a grid work in the doorway supported by the door frame at six points and is reusable; and a continuous metal mount fastened to each side of the door-way from the floor level to about the seven foot level to accommodate the disposable diaphram;

b. said diaphram covering the suspended containing mechanism and being composed of a woven fabric having sufficient strength to span between the horizontal and vertical ordinates of the containing grid mechanism without excessive bulge or failure under load and provided along each vertical edge with a rope bound hem that can be fed into the side mounts from the top end.

3. The invention as defined in claim 2 where the vertical suspension is a steel wire rope.

4. The invention as defined in claim 3 where the steel wire rope is suspended from the top horizontal member of the doorway in a manner that allows the steel wire rope to become detached from its mounting should the stresses become so great that failure is eminent.

5. The invention as defined in claim 2 where the steel wire rope is attached to the boxcar floor by means of a clevis or roller, which fits over a floor mounted projection in such a manner that insures a secure attachment to the boxcar floor when pressure is exerted from the inside but allows the clevis or roller to become detached should sufficient pressure be exerted from the outside.

6. The invention as defined in claim 2 where the horizontal portion of the mechanism is a steel channel iron suspended from the steel wire cables by means of a metal wedge, the channel being cambered toward the inside of the boxcar sufficiently to prevent the diaphram from contacting the outside storm door of the boxcar when loaded; the steel channel being slightly less in length than the width of the boxcar door-way and prevented from passing through the door-way by a projecting stop plate.

7. The invention as defined in claim 2 where the woven fabric diaphram is a fabric woven from "oriented" polypropolene or polyethelene tapes having a denier weight of between 200 and 2,000 and a tape density of between 5 and 30 tapes per inch, the woven fabric being either unlaminated or laminated on one or both sides with a monolithic film.

8. The invention as defined in claim 7, where the fabric diaphram is fitted along each vertical edge with a rope bound hem that will slide in the end of the continuous side mounts.

9. The invention as defined in claim 7, where the diaphram is sufficiently wide to extend well past the vertical door posts and is not tailored along each vertical edge but is secured to the boxcar liner by means of staples, lath bottons and nails.

* * * * *

UNITED STATES PATENT OFFICE

CERTIFICATE OF CORRECTION

Patent No. 3,958,515 Dated May 25, 1976

Inventor(s) Donald James F. GOUDY

It is certified that error appears in the above-identified patent and that said Letters Patent are hereby corrected as shown below:

In the FRONT PAGE FORMAT please change the date of issue to read:

[45] May 25, 1976

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*